United States Patent [19]

Yanagawa et al.

[11] Patent Number: 4,877,496

[45] Date of Patent: Oct. 31, 1989

[54] ZINC-NICKEL ALLOY PLATING SOLUTION

[75] Inventors: Moriyuki Yanagawa, Kawasaki; Shunichi Ishida, Yamato; Ken Ogura, Okazaki; Yushi Saito, Anjo, all of Japan

[73] Assignee: Nippon Hyomen Kagaku Kabushiki Kaisha, Japan

[21] Appl. No.: 291,962

[22] Filed: Dec. 30, 1988

[51] Int. Cl.[4] ..... C25D 3/56

[52] U.S. Cl. ..... 204/44.2

[58] Field of Search ..... 204/44.2

[56] References Cited

FOREIGN PATENT DOCUMENTS 58-34189 2/1983 Japan .
60-181293 9/1985 Japan .
53-285 7/1988 Japan .

*Primary Examiner*—G. L. Kaplan

*Attorney, Agent, or Firm*—Wood, Dalton, Phillips, Mason & Rowe

[57] ABSTRACT

A zinc-nickel alloy plating solution in an aqueous solution comprising, as represented in terms of ions, 4–30 g/liter of zinc and 0.05–4 g/liter of nickel, together with 50–220 g/liter of an alkali hydroxide, 4–110 g/liter of a complexing agent, 0.1–10 g/liter of a primary brightener, 0.01–0.2 g/liter of a booster brightener and preferably, further, 0.01–0.05 g/liter of a tertiary brightener. The primary brightener is at least one selected from the reaction products of amines such as ethylenediamine or its methyl-substituted derivatives, propylenediamine or its methyl-substituted derivatives, diethylenetriamine or its methyl-substituted derivatives, and the like with epihalohydrin. The booster brightener is at least one selected from aromatic aldehydes such as anisaldehyde, vanillin, heliotropin, veratraldehyde, and the like. The tertiary brightener is at least one selected from tellurium oxide, tellurous acid or its salts, or telluric acid or its salt.

8 Claims, No Drawings

ZINC-NICKEL ALLOY PLATING SOLUTION

BACKGROUND OF THE INVENTION

This invention relates to a zinc-nickel alloy plating solution, particularly to a zinc-nickel alloy plating solution with good brightness and excellent corrosion resistance.

Zinc-nickel alloy plating has extremely excellent corrosion resistance as compared with zinc plating, being particularly excellent in corrosion resistance under heated environment of around 200° C. and therefore it is attracting attention and some of its plating solution compositions have been proposed.

Uses of zinc type alloy plating may be broadly classified into production of plated steel plates and provision of general parts (press work articles, bolts, etc.). Plated steel plates are generally produced by high speed plating (30 to 100 A/dm$^2$) from sulfuric acidic bath, and zinc-iron alloy plating making great account of coating adhesion or zinc-nickel alloy plating excellent in corrosion resistance, etc., has been known (e.g. Japanese Laid-open Patent Publication No. 152194/1980). However, these platings have been developed as the plating of steel plates for base plates to be coated, and are not suitable for plating of general parts, because they are poor in brightness and also plating cannot be attached onto the low current density portion (concave portion).

Zinc type alloy plating of general parts is attracting attention for making corrosion resistance of zinc plating higher as a counter measure against injury of salt of automobile parts, and already widely prevailing zinc-iron alloy plating based on zincate bath zinc plating (Japanese Laid-open Patent Publication No. 181293/1985) or zinc-nickel alloy plating based on chloride bath zinc plating (Japanese Laid-open Patent Publication No. 34189/1983) has been known.

Zinc-iron alloy plating from a zincate bath, while having much advantages such as uniform alloy composition obtained, excellent corrosion resistance, low cost, easy chromate treatment, etc., has the drawback that corrosion resistance is abruptly worsened when heat of 150° C. or higher is applied, and therefore not suitable for parts subjected to heat. On the other hand, zinc-nickel alloy plating, while having the advantage of maintenance of excellent corrosion resistance without deterioration of corrosion resistance even when subjected to heat, involves the drawbacks that corrosion resistance is not stable due to great difference in nickel co-deposition amount depending on current distribution and also that the cost is higher due to higher nickel ion concentration in the bath, and therefore other baths are demanded. For such reasons, it has been also attempted to obtain a uniform alloy plating coating of high corrosion resistance at low cost by applying the zincate bath for zinc-nickel alloy plating, but as the result no satisfactory brightness could be obtained as plating of general parts.

That is, it has been proposed to apply zincate bath for zinc-nickel alloy plating ("Investigations of Complexing Agents for Alkaline Zn-Ni Alloy Plating Bath", Gists of 70th Academic Lecture Meeting of Society of Metal Surface Technology). According to this proposal, by use of an appropriate complexing agent (Ni solubilizing agent), a zincate bath lowered in both concentrations of zinc and nickel can be constituted, whereby the production cost can be lowered. As effective complexing agents, tartaric acid, gluconic acid, ethylenediamine and derivatives thereof are reported. Whereas, the zinc-nickel alloy plating thus obtained has no brightness, and the Ni co-precipitation ratio at the low current density portion becomes 2-fold or more of that at medium to high current density portion, as unsuitable for chromate treatment for improvement of corrosion resistance and appearance.

In the prior art, a large number of brighteners for giving brightness to plated film have been proposed. The present applicant attempted to add most of these known brighteners into alkaline zinc-nickel alloy zincate bath, only to obtain substantially no effect. Particularly, there was no satisfactory brightness at the low current density portion which is important to plating at the concave portion of general parts.

SUMMARY OF THE INVENTION

An object of the present invention is to provide a zincate plating solution capable of forming corrosion resistant zinc-nickel alloy plating excellent in brightness, uniform electrodeposition and uniformness of alloy ratio.

The zinc-nickel plating solution of the present invention is an aueous solution comprising, as represented in terms of ions, 4 to 30 g/liter of zinc and 0.05 to 4 g/liter of nickel, together with 50 to 220 g/liter of an alkali hydroxide, 4 to 110 g/liter of a complexing agent, 0.1 to 10 g/liter of a primary brightener as defined below, 0.01 to 0.2 g/liter of a booster brightener, preferably further 0.1 to 5 g/liter of a tertiary brightener. Here, the primary, booster and tertiary brigheners are as defined below.

Primary brightener:

reaction product of amines such as ethylenediamine or its methyl-substituted derivatives, propylenediamine or its methyl-substituted derivatives, diethylenetriamine or its methyl-substituted derivatives and the like with epihalohydrin.

Booster brightener:

aromatic aldehydes such as anisaldehyde, vanillin, heliotropin, veratraldehyde and the like.

Tertiary brighener:

tellurium oxide, tellurous acid, tellurous acid salts, telluric acid, telluric acid salts.

The plating solution of the present invention is good in unchromated corrosion resistance and the so called heat-resistant corrosion resistance under the environment subjected to heat, also broad in brightness range, and yet can form a zinc-nickel alloy electrodeposited film with uniform composition. The plated film thus formed can give uniform film due to uniform alloy composition in the chromate film chemical treatment for improving markedly corrosion resistance. Further, the plating solution of the present invention is lower in nickel concentration to be inexpensive.

DETAILED DESCRIPTION OF THE INVENTION

Plating solution components and ranges

The present inventors have studied intensively in order to improve brightness, corrosion resistance, uniform electrodepositability, uniform alloy ratio of zinc-nickel alloy plating, and consequently found that the compositions shown below in Table 1 can accomplish the intended object as the zincate type plating solutions capable of satisfying these characteristics. In Table 1, preferable ranges and standard compositions are also listed together.

TABLE 1

| Liquid component | Standard | Preferable range | Effective range |
|---|---|---|---|
| Zinc | 13 g/liter | 6–20 g/liter | 4–30 g/liter |
| Nickel | 0.6 g/liter | 0.3–0.9 g/liter | 0.05–4 g/liter |
| Alkali hydroxide*1 | 110 g/liter | 80–150 g/liter | 50–220 g/liter |
| Complexing agent | 20 g/liter | 10–50 g/liter | 4–110 g/liter |
| Brightener: | | | |
| Primary | 3 g/liter | 1–6 g/liter | 0.1–10 g/liter |
| Booster | 0.04 | 0.02–0.06 | 0.01–0.2 |
| (Tertiary)*2 | (0.02) | (0.01–0.05) | (0.01–0.1) |

*1Alkali hydroxide: alkali metal hydroxide such as lithium hydroxide, sodium hydroxide, potassium hydroxide, etc.
*2Preferable additional component Some of the compositions shown in Table 1 are partially known except for the point of brightener (see the above Gists of the Society of Metal Surface Technology).

However, according to the known zincate type zinc-nickel alloy plating solution, by use of a known brightener conventionally used in zinc plating (the above booster brightener is one example thereof), the brightness range is narrow, and particularly bad brightness and increase in nickel co-deposition amount at the low current density portion cannot be avoided, whereby uniform chromate film can be applied with difficulty to give no practical quality in both aspects of appearance and corrosion resistance.

The present invention, by addition of primary and booster brighteners or further a tertiary brightener, has made the plating solution capable of giving excellent brightness with broad current density range as well as uniform alloy ratio, and also capable of forming a zinc-nickel alloy plated film excellent in all of unchromated corrosion resistance and corrosion resistance after chromate treatment and heat-resistant corrosion resistance.

Here, the reasons for restricting the effective ranges of the components in the zinc-nickel alloy plating solution of the present invention are shown in Table 2.

TABLE 2

| | Effective range | | |
|---|---|---|---|
| Zinc | 4–30 g/liter | Lower limit: | Lowering current efficiency, worsening of workability |
| | | Upper limit: | Narrow brightness range. Worsening of physical properties of plated film |
| Nickel | 0.05–4 g/liter | Lower limit: | Worsening of corrosion resistance due to shortage in nickel codeposition amount |
| | | Upper limit: | Narrow brightness range, worsening of chromate treatment |
| Alkali hydroxide | 50–220 g/liter | Lower limit: | Worsening of physical properties of plated film. Worsening of uniform electrodepositability |
| | | Upper limit: | Worsening of plated film leveling characteristic |
| Complexing agent | 4–110 g/liter | Lower limit: | Nickel is insoluble. Unstable codeposition ratio |
| | | Upper limit: | Lowering in current efficiency |
| Brightener: | | | |
| Primary | 0.1–10 g/liter | Lower limit: | Narrow brightness range. Rough plated film |
| | | Upper limit: | Worsening of physical properties of plated film |
| Booster | 0.01–0.2 g/liter | Lower limit: | Shortage in brightness. Worsening of leveling characteristic |
| | | Upper limit: | Worsening of physical properties or plated film |
| Tertiary | 0.01–0.1 g/liter | Lower limit: | Worsening of brightness at low current density, increase in nickel codeposition |
| | | Upper limit: | Lowering in leveling characteric at high current portion |

Of the above components, the brighteners may be only the primary and booster brighteners, but by further addition of a tertiary brightener, a uniform alloy composition can be obtained even to the low current density region, whereby excellent alloy plated film improved also in brightness can be obtained.

METAL IONS

The basic composition of the plating solution of the present invention is the same as the known zinc plating zincate bath (zinc oxide and alkali hydroxide), and as the nickel, a nickel salt such as nickel sulfate, nickel carbonate, basic nickel carbonate, nickel chloride, etc., or a nickel hydroxide or nickel complexed with a complexting agent as described below may be employed.

COMPLEXING AGENT

The complexing agent (chelating agent) plays an important role in giving sufficient nickel ion concentration even at a low concentration by solubilization of nickel and further making the nickel co-precipitation ratio uniform. The complexing agent suited for the object of the present invention not only effects stable dissolution by complexing nickel ions to electrodepositable extent at strong alkalinity of pH about 13 or higher, but also should not give bad influences with respect to brightness, physical properties, co-deposition ratio, etc., on the plating.

As the complexing agent to be used in the present invention capable of giving a nickel codeposition ratio of 2% or more, ethylenediamine (EDA), ethylenetriamine, polyethylenepolyamines such as diethylene triamine (DETA), triethylenetetramine (TETA), N-hydroxyethylenediamine (HEEDA), etc., and alkalnol amines such as diethanolamine (DEA), triethanolamine (TEA), N-methylethanolamine, 2-aminopropanol, etc., may be preferably used. The complexing agent capable of giving a nickel codeposition ratio of 0.1 to 2% may include aminocarboxylic acid salts such as nitrilotriacetate, ethylenediamine-tetraacetate, etc., oxycarboxylic acid salts such as citrate, tartarate, gluconate, glycolate, etc., polyhydric alcohols such as sorbitol, mannitol, pentaerythritol, etc.

Due to the presence of these complexing agents, the nickel content in the alloy plating film electrodeposited from a bath having nickel ions dissolved at 0.05 to 4 g/liter can be within the range of from 0.1% to 15%.

BRIGHTENERS

The primary brightener to be used in the present invention makes plating crystals dense and gives semi-brightness when used alone. The booster brightener gives strong brightness. in the present invention, it is important to use primary and booster brighteners in combination, and by doing so, naked corrosion resistance and heat-resistance corrosion resistance of zinc-nickel alloy plating can be greatly improved, and also brightness becomes better. Further, this plating film is extremely excellent as the base for chromate treatment, and brightness and corrosion resistance are markedly improved by this treatment. Also, by use of a tertiary brightener, abnormal increase of the amount of nickel coprecipitated at the ultra-low current density portion, and also brightness becomes better, whereby uniformness of the chromate film can be given simultaneously with improvement of corrosion resistance. The primary brightener is the most important in the present invention, and the plating film is rough and inferior in corrosion resistance without use of this, and also chromate film cannot be applied uniformly. In other words, the characteristics related to plating quality such as brightness range, physical properties of plating film, corrosion resistance, chromate treatability, etc., are substantially determined depending on the performance of the primary brightener. The booster brightener is a general compound used widely as the zinc plating brightener. The tertiary brightener may not be used if the working condition and the plating part are limited, but by use of this, the concave portion of plated part is improved and the plating working conditions can be expanded so as to be correspondable to a large number of plated parts.

The primary brightener is selected from the reaction products of amines such as ethylenediamine or its methyl-substituted derivatives, propylenediamine or its methyl-substituted derivatives, diethylenetriamine or its methyl-substituted derivatives and the like and epihalohydrin.

For example, there may be employed a reaction product:

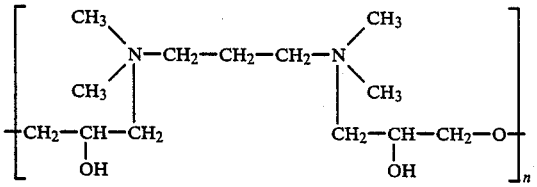

from one mol of tetramethylpropylenediamine:

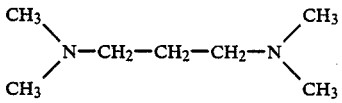

and 0.8 to 1.5 mols of epichlorohydrin:

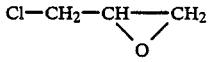

As the booster brightener, aromatic aldehydes such as anisaldehyde, vanillin, heliotropin, veratraldehyde, and the like and other known brighteners for zinc plating can be used.

The tertiary brightener includes tellurium oxide, tellurous acid, tellurous acid salts, telluric acid, telluric acid salts.

PLATING WORKING AND CHROMATE TREATMENT

The zinc-nickel alloy plating solution of the present invention may be used for plating working under the conditions shown in Table 3.

TABLE 3

| | Standard | Preferable range | Effective range |
|---|---|---|---|
| Brightness range | — | 0.2–12 A/dm$^2$ | 0.1–15 A/dm$^2$ |
| Average current density (Rack) | 3 A/dm$^2$ | 2–4 A/dm$^2$ | 0.5–4.5 A/dm$^2$ |
| (Barrel) | 0.7 A/dm$^2$ | 0.5–0.9 A/dm$^2$ | 0.3 A/dm$^2$ |
| Plating temperature | 20° C. | 15–25° C. | 10–40° C. |

The plated film thus obtained itself has good brightness and excellent corrosion resistance (unchromated corrosion resistance), but marked corrosion resistance can be further obtained by chromate treatment. Particularly, from a plated film with a Ni coprecipitation ratio of 4% or higher, a bright chromate, colored chromate film capable of maintaining high corrosion resistance even when subjected to heat history of 200° C., and also with a nickel coprecipitaation ratio of 4% or lower, a bright chromate, colored chromate, green chromate, black chromate (without use of silver) with good corrosion resistance can be applied. Thus, excellent effects which were not conceivable in the zinc-nickel alloy zincate bath of the prior art can be obtained.

The present invention is described below by referring to Examples. In these Examples, brightness is represented by appearance and corrosion resistance by the time until generation of red rust when steel plate is used as the base following the salt spray test (JIS Z-2371).

EXAMPLE 1

As the test strip, a bright steel plate with one surface of 0.5 dm$^2$ was used for the cathode, and plating was conducted under the conditions of a liquid temperature of 20° C. and current densities of 0.5 A/dm$^2$ and 3.0 A/dm$^2$, respectively. The plating solution used contained 13 g/liter of zinc, 0.6 g/liter of nickel, 110 g/liter of sodium hydroxide, 20 g/liter of a 3:1 (weight ratio) mixture of complexing agents N-hydroxyethylenediamine and triethanolamine, 3 g/liter of a reaction product of 1 mol of tetramethylpropylenediamine and 1 mol of epichlorohydrin as the primary brightener and 0.04 g/liter of vanillin as the booster brightener.

Under such conditions, plating with a film thickness of 5 μm was applied and consequently a beautiful bright film with a nickel codeposition ratio of 6.5% was obtained at the current density of 3.0 A/dm$^2$, and a semi-bright plated film at the central portion with nickel codeposition ratio of 1.8% at 0.5 A/dm$^2$. Unchromated corrosion resistance of the plated film and corrosion resistance of the film applied with colored chromated treatment (Romate #62S produced by Nippon Hyomen Kagaku, 20 cc/liter of 40° C., 10 sec.) were examined in presence and absence of baking (200° C.—3 hr), respectively to obtain the results shown in Table 4.

Also, for comparative purpose, corrosion resistance of a similar test strip applied with zinc plating to a thickness 5 μm was tested at the same time, and the results are shown in Table 4.

TABLE 4

| Plating current density | Presence of baking | Salt spray test (JIS Z-2371) time until generation of red rust |
|---|---|---|
| | Example 1 | |
| | Unchromated corrosion resistance: | |
| 0.5 A/dm$^2$ | None | 240 H |
| | " | 240 H |
| 3.0 A/dm$^2$ | None | 336 H |
| | " | 360 H |
| | Corrosion resistance after chromating: | |
| 0.5 A/dm$^2$ | None | 720 H |
| | " | 696 H |
| 3.0 A/dm$^2$ | None | 1512 H |
| | " | 1560 H |
| | Comparative example (Zn plating) | |
| | Naked corrosion resistance: | |
| 3.0 A/dm$^2$ | None | 72 H |
| | " | 24 H |
| | Corrosion resistance after chromating: | |
| 3.0 A/dm$^2$ | None | 312 H |
| | " | 96 H |

EXAMPLE 2

As the result of application of plating to a film thickness of 5μ under entirely the same conditions as in Example 1 except for adding 0.02 g/liter of sodium tellurite as the tertiary brightener into the plating solution, the nickel codeposition ratio was found to be 6.4% at the current density of 3.0 A/dm$^2$ and 6.7% at 0.5 A/dm$^2$, and appearances were good in brightness in both cases.

Further, naked corrosion resistance of the plated film and corrosion resistance of the film applied with colored chromate treatment (Lowmate #62S, produced by Nippon Hyomen Kagaku, 20 cc/liter, 40° C., 10 sec.) were examined in presence or absence of baking (200° C.—3 hr) were examined similarly as in Example 1 to obtain the results shown in Table 5.

TABLE 5

| Plating current density | Presence of baking | Salt spray test (JIS Z-2371) time until generation of red rust |
|---|---|---|
| | Example 2 | |
| | Unchromated corrosion resistance: | |
| 0.5 A/dm$^2$ | None | 456 H |
| | " | 456 H |
| 3.0 A/dm$^2$ | None | 480 H |
| | " | 528 H |
| | Corrosion resistance after chromating: | |
| 0.5 A/dm$^2$ | None | 2400 H |

TABLE 5-continued

| Plating current density | Presence of baking | Salt spray test (JIS Z-2371) time until generation of red rust |
|---|---|---|
| | " | 2160 H |
| 3.0 A/dm$^2$ | None | 2280 H |
| | " | 2492 H |

EXAMPLE 3

As the test strip, a bright steel plate with one surface of 0.5 dm$^2$ was used for the cathode, and plating was conducted under the conditions of a liquid temperature of 20° C. and a current density of 3.0 A/dm$^2$.

The plating solution employed contained 20 g/liter of zinc, 0.9 g/liter of nickel, 130 g/liter of sodium hydroxide, 40 g/liter of tartaric acid as the complexing agent, 1 g/liter of a reaction product of 1 mol of dimethylaminopropylamine and 1 mol of epichlorohydrin, as the primary brightener, 0.05 g/liter of veratraldehyde as the booster brightener and 0.01 g/liter of sodium tellurate as the tertiary brightener.

In the test strip obtained, the nickel codeposition ratio was 0.4% and an appearance with mirror surface luster was obtained, and further by colored chromate and black chromate treatment, it became a beautiful appearance not inferior to zinc plating.

As the result of of examination of corrosion resistance after these chromate treatments (brine spray test JIS Z-2371), it took 2000 hours or longer until generation of red rust in both cases of colored chromate and black chromate.

EXAMPLE 4

As the result of preparation of a test strip in the same manner as in Example 3 except for using 6 g/liter of zinc, 0.5 g/liter of nickel, 110 g/liter of sodium hydroxide and 10 g/liter of disodium ethylenediamine tetraacetate as the complexing agent, a film with brightness with nickel codeposition ratio of 1.6% was obtained. Corrosion resistance of the plated film is shown in Table 6.

EXAMPLE 5

As the result of preparation of a test strip in the same manner as in Example 3 except for using 20 g/liter of zinc, 0.8 g/liter of nickel, 180 g/liter of sodium hydroxide and 50 g/liter of triethanolamine as the complexing agent, a plated film with brightness of nickel codeposition ratio of 12.5% was obtained. However, brightness of the chromate could be obtained with difficulty. The results of corrosion resistance of the film are shown in Table 6.

TABLE 6

| Example | | Baking (200° C.) 3 Hr) | Corrosion resistance Salt spray test (JIS Z-2371) time until generation of red rust |
|---|---|---|---|
| Example 4 | Unchromated corrosion resistance | None | 144 H |
| | | " | 72 H |
| | Corrosion resistance after chromating | None | 2400 H |
| | " | 504 | H |
| Example 5 | Unchromated corrosion resistance | None | 62 H |

TABLE 6-continued

| Example | | Baking (200° C.) 3 Hr) | Corrosion resistance Salt spray test (JIS Z-2371) time until generation of red rust |
|---|---|---|---|
| | " | 720 | H |
| Corrosion resistance | None | 1440 | H |
| | after chromating " | 1320 | H |

What is claimed is:

1. A zinc-nickel alloy plating solution comprising, as represented in terms of metal ions, 4 to 30 g/liter of zinc, 0.05 to 4 g/liter of nickel, 50 to 220 g/liter of an alkali hydroxide, 4 to 110 g/liter of a complexing agent, 0.1 to 10 g/liter of a primary brightener and 0.01 to 0.2 g/liter of a booster brightener, characterized in that said primary brightener is at least one selected from the reaction products of at least one amine from the group consisting of ethylenediamine or its methyl-substituted derivatives, propylenediamine or its methyl-substituted derivatives, and diethylenetriamine or its methyl-substituted derivatives, with epihalohydrin, and said booster brightener is at least one aromatic aldehyde selected from the group consisting of anisaldehyde, vanillin, heliotropin, and veratraldehyde.

2. A zinc-nickel alloy plating solution comprising, as represented in terms of metal ions, 4 to 30 g/liter of zinc, 0.05 to 4 g/liter of nickel, 50 to 220 g/liter of an alkali hydroxide, 4 to 110 g/liter of a complexing agent, 0.1 to 10 g/liter of a primary brightener, 0.01 to 0.2 g/liter of a booster brightener, and 0.01 to 0.1 g/liter of a tertiary brightener, characterized in that said primary brightener is at least one selected from the reaction products of at least one amine from the group consisting of ethylenediamine or its methyl-substituted derivatives, propylenediamine or its methyl-substituted derivatives, and diethylenetriamine or its methyl substituted derivatives, with epihalohydrin, said booster brightener is at least one aromatic aldehyde selected from the group consisting of anisaldehyde, vanillin, heliotropin, and veratraldehyde, and said tertiary brightener is at least one selected from tellurium oxide, tellurous acid or its salts, and telluric acid or its salts.

3. A zinc-nickel alloy plating solution comprising, as represented in terms of metal ions, 4 to 30 g/liter of zinc, 0.05 to 4 g/liter of nickel, 50 to 220 g/liter of an alkali hydroxide, 4 to 110 g/liter of a complexing agent, 0.1 to 10 g/liter of a primary brightener and 0.01 to 0.2 g/liter of a booster brightener, characterized in that said primary brightener is at least one selected from the reaction products of at least one amine with epihalohydrin, and said booster brightener is at least one aromatic aldehyde.

4. The solution as recited in claim 3 wherein the amine or amines are selected from a group consisting of ethylenediamine or its methyl-substituted derivatives, propylenediamine or its methyl-substituted derivatives, and diethylenetriamine or its methyl-substituted derivatives.

5. The solution as recited in claim 3 wherein the aromatic aldehyde or aldehydes are selected from a group consisting of anisaldehyde, vanillin, heliotropin, and veratraldehyde.

6. A zinc-nickel alloy plating solution comprising, as represented in terms of metal ions, 4 to 30 g/liter of zinc, 0.05 to 4 g/liter of nickel, 50 to 220 g/liter of an alkali hydroxide, 4 to 110 g/liter of a complexing agent, 0.1 to 10 g/liter of a primary brightener, 0.01 to 0.2 g/liter of a booster brightener, and 0.01 to 0.2 g/liter of a tertiary brightener, characterized in that said primary brightener is at least one selected from the reaction products of at least one amine with epihalohydrin, said booster brightener is at least one aromatic aldehyde, and said tertiary brightener is at least one selected from tellurium oxide, tellurous acid or its salts, and telluric acid or its salts.

7. The solution as recited in claim 6 wherein the amine or amines are selected from a group consisting of ethylenediamine or its methyl-substituted derivatives, propylenediamine or its methyl-substituted derivatives, and diethylenetriamine or its methyl-substituted derivatives.

8. The solution as reached in claim 6 wherein the aromatic aldehyde or aldehydes are selected from a group consisting of anisaldehyde, vanillin, heliotropin, and veratraldehyde.

* * * * *

UNITED STATES PATENT AND TRADEMARK OFFICE

CERTIFICATE OF CORRECTION

PATENT NO. : 4,877,496

DATED : October 31, 1989

INVENTOR(S) : Moriyuki Yanagawa, Shunichi Ishida, Ken Ogura, and Yushi Saito

It is certified that error appears in the above-identified patent and that said Letters Patent is hereby corrected as shown below:

Title page:

Item [73] - The following are the correct Assignees and should both be listed:

Nippon Hyomen Kagaku Kabushiki Kaisha and Nippondenso Co., Ltd., both of Japan

Signed and Sealed this

Thirteenth Day of November, 1990

*Attest:*

HARRY F. MANBECK, JR.

*Attesting Officer*

*Commissioner of Patents and Trademarks*